US005351614A

United States Patent [19]

Depa

[11] Patent Number: 5,351,614

[45] Date of Patent: Oct. 4, 1994

[54] SELF-OSCILLATING ROLLER ASSEMBLY AND METHOD

[75] Inventor: Louis S. Depa, Downers Grove, Ill.

[73] Assignee: Rockwell International Corporation, Seal Beach, Calif.

[21] Appl. No.: 787,857

[22] Filed: Nov. 5, 1991

[51] Int. Cl.[5] ..... B41F 31/26

[52] U.S. Cl. ..... 101/148; 101/348; 101/DIG. 38

[58] Field of Search ..... 101/148, 348, 349, DIG. 38

[56] References Cited

U.S. PATENT DOCUMENTS 2,928,341 3/1960 Taylor ..... 101/348
4,546,701 10/1985 Junghans ..... 101/DIG. 38
4,785,514 11/1988 Kannwischer ..... 101/348

*Primary Examiner*—Edgar S. Burr
*Assistant Examiner*—Stephen R. Funk
*Attorney, Agent, or Firm*—C. B. Patti; V. L. Sewell; H. F. Hamann

[57] ABSTRACT

A self-oscillating roller assembly (10, 10A, 10B, 10C, 10D) with an oscillating shaft (54) mounted on translational bearings (58, 60) to slide along a stationary shaft (48) and with a rotary shaft (55) mounted to the oscillating shaft (54) on rotational bearings (80, 82) to provide rotational movement. A key assembly (62, 63, 64, 66) restrains the relative longitudinal movement between the oscillating shaft (54) and the rotary shaft (55) while a pair of springs (68, 70) provides bias to return the rotary shaft (55) and oscillating shaft (54) to a preselected home position.

16 Claims, 2 Drawing Sheets

SELF-OSCILLATING ROLLER ASSEMBLY AND METHOD

BACKGROUND OF THE INVENTION

FIELD OF THE INVENTION

This invention generally relates to a self-oscillating roller assembly and method of oscillating an oscillating roller of an offset printing press or the like.

DESCRIPTION OF THE RELATED ART INCLUDING INFORMATION DISCLOSED UNDER 37 CFR 1.97-1.99

Offset printing assemblies are well known which employ one or more oscillating rollers in either or both of the dampening liquid roller train and the inking roller train. These oscillating rollers oscillate back and forth in the axial direction while in contact with an ink carrying roller, dampening liquid carrying roller or ink and dampening liquid carrying roller. When such oscillating rollers are used in the dampening liquid train, the uniformity of water film thickness on the printing plate cylinder is enhanced. In addition, use of an oscillating roller increases the speed of cleaning the printing plate during start-up and thereby reduces start-up waste. Further, scumming at the edges of the printing plates is reduced or eliminated which also reduces waste and enhances print quality.

It is known to drive such oscillating rollers only via complex gear trains and cams. Consequently, such known oscillating rollers cannot be used in inking rollers and dampening rollers without tremendous cost and complexity. Moreover, the known oscillating rollers employ a single shaft which is both rotated and oscillated within a single sleeve bearing at each end of the shaft. This single sleeve bearing must take up the load of both types of movement. Consequently, excessive heat is generated such that each of the sleeve bearings requires virtually continuous lubrication and cannot be provided with sealed lubrication fittings or lubricated only periodically due to resultant thermal break down.

More recently, such oscillating rollers have been friction driven via contact with vibrating drives which are printer driven and oscillate themselves to cause the oscillating rollers to oscillate. These vibrating drum driven oscillators, or self-oscillating rollers, function successfully, but they continue to suffer from the problem resulting from use of a single bearing to support both rotary and oscillating movement. In addition, because of the high friction in the bearings of known self-oscillating rollers, substantial pressure must be applied to the self-oscillating rollers from the vibrating drums in order to achieve the desired degree of movement.

SUMMARY OF THE INVENTION

It is therefore the principal object of the present invention to provide a self-oscillating roller assembly which has separate bearings for rotational and translational movement to facilitate such movement by reducing the concentration of heat generated by bearing friction to reduce the amount of lubrication service required.

This objective is achieved in part through provision of a self-oscillating roller assembly comprising an oscillating shaft assembly including an elongate oscillating shaft and means for mounting the oscillating shaft for sliding movement in the elongate direction of the shaft, and a rotatable shaft assembly including an elongate rotary shaft and means for mounting the rotary shaft for rotational movement around the elongate oscillating shaft.

The object is also achieved by providing the self-oscillating roller assembly with a stationary shaft and in providing the oscillating shaft assembly with a translational bearing and means for mounting the translational bearing to the elongate shaft to support the elongate cylindrical shaft for sliding movement along the stationary shaft.

The object is achieved in the preferred embodiment by providing the above self-oscillating roller assembly with means for biasing the elongate oscillating shaft toward a preselected home position.

Preferably, the self-oscillating roller assembly is provided with an elongate rotary shaft having a cylindrical body along a significant portion of its length and an inner wall spaced from the oscillating shaft within which such space the home position biasing means is contained.

In a preferred embodiment of the self-oscillating roller of the present invention, the rotary shaft mounting means includes a pair of rotational bearings carried at opposite ends of the rotary shaft.

Also, the double bearing construction of the self-oscillating roller assembly of the present invention advantageously enables use of a permanently sealed lubrication fitting for providing lubrication between the elongate rotary shaft and the rotary bearings.

A further object of the invention is achieved by providing a self-oscillating roller assembly comprising (1) an elongate, stationary shaft assembly including an elongate, stationary shaft and means for mounting the elongate, stationary shaft in a fixed position,
(2) an elongate, cylindrical, rotary shaft,
(3) an elongate, cylindrical, oscillating shaft,
(4) means for mounting one of the elongate, cylindrical, rotary shaft and the elongate, cylindrical, oscillating shaft to the elongate stationary shaft for respective rotary and oscillating movement relative thereto, and
(5) means for mounting the other of the elongate, cylindrical, rotary shaft and the elongate, cylindrical, oscillating shaft to the one of the elongate, cylindrical, rotary shaft and the elongate, cylindrical, oscillating shaft mounted to the stationary shaft for respective rotary and oscillating movement relative thereto.

The object of the present invention is also achieved by providing a method of oscillating an oscillating roller assembly along the length of another roller during rotation thereof comprising the steps of rotating a rotary shaft of the oscillating roller assembly relative to an elongate, oscillating shaft and longitudinally oscillating the elongate, oscillating shaft. Preferably, the oscillating shaft is slid along a stationary shaft.

BRIEF DESCRIPTION OF THE DRAWINGS

The foregoing objects and advantageous features of the invention will be explained in greater detail and others will be made apparent from the detailed description of the preferred embodiment of the present invention which is given with reference to the figures of the drawing, in which.

DESCRIPTION OF THE PREFERRED EMBODIMENT

Figure 1:
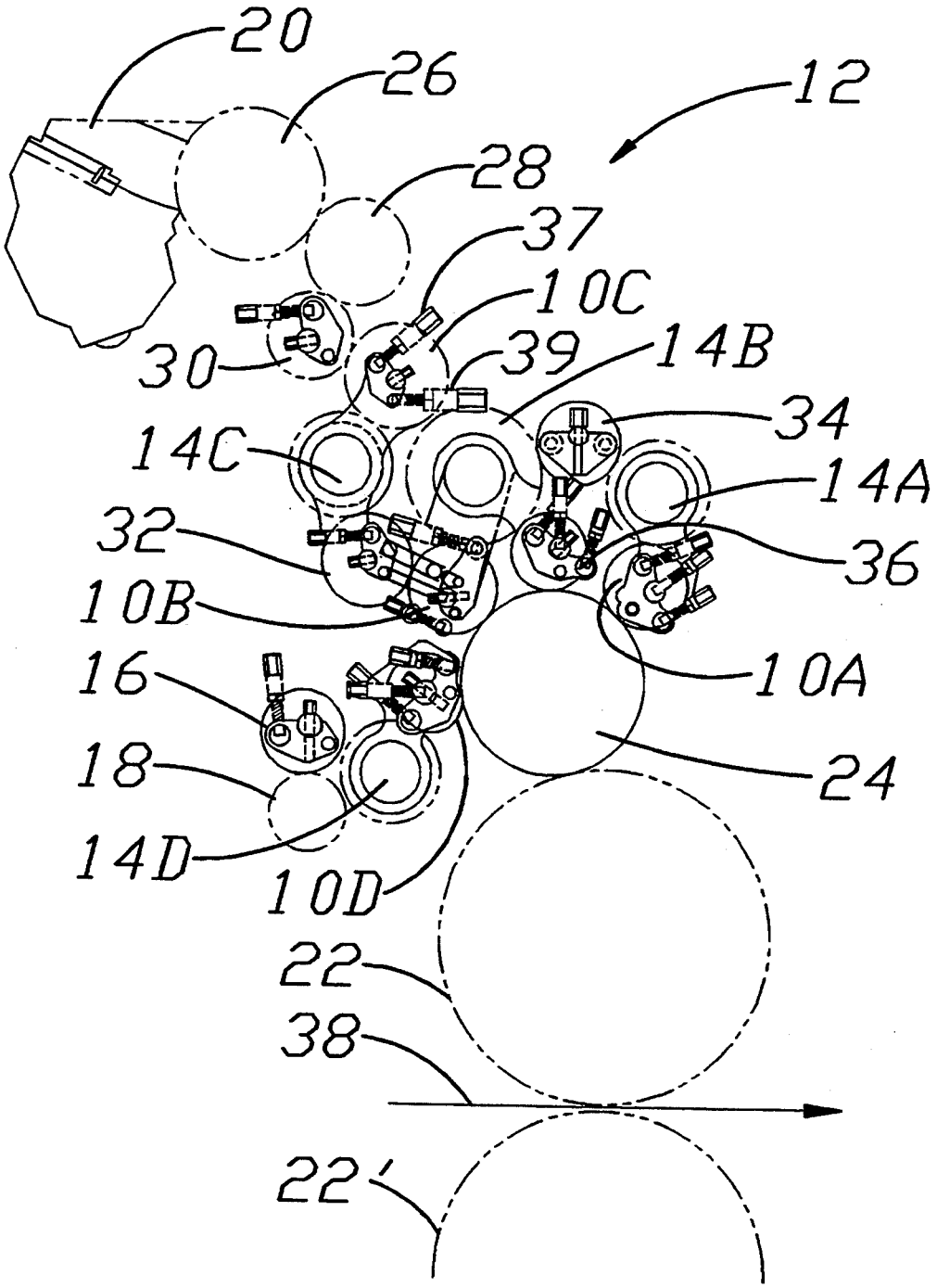
FIG. 1 is a schematic illustration of an offset printing system in which the self-oscillating roller assembly of the present invention is employed.
Figure 2:
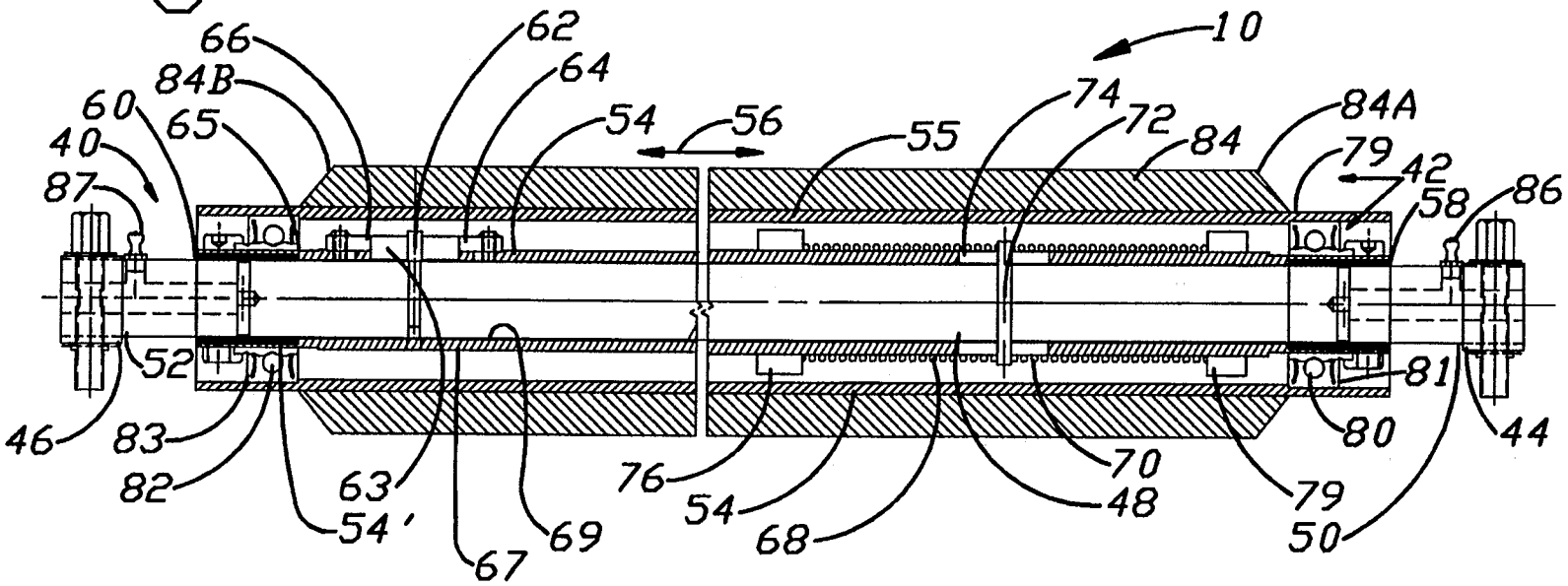
FIG. 2 is a detailed cross sectional side view taken along the elongate axis of the preferred embodiment of the self-oscillating roller assembly of the present invention.

Referring to the drawings, a preferred embodiment of the self-oscillating roller assembly 10 of the present invention shown in FIG. 2 in detail is illustrated in FIG. 1 as used in an offset printing system or printer 12. In the printer 12, three self-oscillating rollers 10A, 10B and 10C are employed but it should be appreciated that a greater or lesser number could be successfully employed. For instance, preferably roller 10D, which functions as a water form roller, is also an oscillating roller if not a self-oscillating roller. Rollers 10A and 10B function as ink form rollers, while self-oscillating roller 10C functions as an ink transfer roller.

All of the self-oscillating rollers are driven into oscillatory motion along their elongate axis by frictional coupling with vibrating drums which are printer driven to oscillate back and forth along their respective major axes. Vibrating drums 14A, 14B and 14C are in contact with and cause the back and forth oscillation of self-oscillating rollers 10A, 10B and 10C, respectively.

Because of low friction on the water dampening side of the printer 12, dampening form roller 10D is not easily oscillated by frictional contact with the vibrating drum 14D, and if the frictional contact is insufficient, then roller 10D is not oscillated or, if oscillated, is driven by means other than vibrating drum 14D. In any event, the dampening liquid is conveyed to water form roller 10D by means of drum 14D, a brush roller 16 and a water pan roller 18.

On the ink side of the system, ink from an ink fountain 20 is conveyed to the blanket cylinder 22 and plate cylinder 24 via means including an ink drum 26, a micrometric ink feed roller 28, and an ink transfer roller 30. Ink from the self-oscillating ink transfer roller 10C is conveyed via the vibrating drum 14C and an ink transfer roller 32 to the self-oscillating ink form roller 10B. Ink is also conveyed to the plate cylinder 24 from the vibrating drum 14B via an ink transfer roller 34 and an ink form roller 36.

The uniformity of the ink film is first enhanced by the oscillating action of the self-oscillating ink transfer roller 10C and the vibrating drum 14C before the ink reaches the plate cylinder 24. Both the ink and the dampening liquid are emulsified together on the plate cylinder by means of the combined rotary and oscillatory action of self-oscillating ink form rollers 10A and 10B and the self-oscillating dampening form roller 10D. As described above, the oscillatory action enhances uniformity and printing quality in general. As the vibrating drums move back and forth along their major axes, they cause the surface in contact therewith of the associated self-oscillating roller to move in an oscillatory fashion while also rotating.

The longitudinal forces needed to establish the oscillatory movement of the self-oscillating rollers are conveyed from the vibrating drums to their associated self-oscillating rollers by the frictional forces therebetween and by the reactionary forces from bias springs carried by the self-oscillating rollers as will be described in detail with reference to FIG. 2. Each of the self-oscillating rollers 10A, 10B, 10C and 10D is preferably provided with an adjusting screw 37 for setting the self-oscillating roller to the associated vibrating drums 14A, 14B, 14C and 14D. Another adjusting screw 39 is provided for adjusting the position of the self-oscillating roller assembly relative to the plate cylinder 24 or other cylinders with which it is in contact.

In a perfecting press, another blanket cylinder 22' is located in an opposed position relative to the blanket cylinder 22 with a web of paper 38, so that both sides of the web 38 may be printed upon simultaneously. A train of rollers, self-oscillating rollers and vibrating drums substantially identical to that shown associated with blanket cylinder 22 are associated with blanket cylinder 22', although not shown.

Unlike known oscillating rollers, the self-oscillating roller 10 of the present invention includes a pair of roller assemblies: an oscillating roller assembly 40 and a rotatable roller assembly 42.

The oscillating roller assembly includes an elongate stationary shaft 48 which is mounted at opposite ends to support bushings 44 and 46 to which is mounted, for oscillating sliding movement, an elongate, cylindrical, oscillating roller 54. The elongate oscillating shaft 54 has an interior surface 67 and exterior surface 69 which extend substantially coextensively with the stationary shaft 48 between the opposed fixed ends of the stationary shaft 48. The cylindrical oscillating roller 54 surrounds the stationary shaft 48 and is mounted for sliding back and forth movement in the direction of double-headed arrow 56 along the stationary shaft 48 by means of a pair of translational cylindrical bearings 58 and 60 carried at opposite ends of the oscillating shaft 54. Periodic lubrication is provided to translational, cylindrical bearings by means of lubrication fittings 86 and 87 mounted on the stationary shaft. The translational bearings 58 and 60 are carried at annular grooves 65 formed in the interior surface 67 of the oscillating shaft 54 adjacent the opposed ends of the stationary shaft 48. Sections 54' of oscillating shaft 54, at which the annular grooves 65 are formed, are thus interposed between the translational bearings 58 and 60 and the rotational bearings 80 and 82.

The rotatable roller assembly 42 includes an elongate cylindrical, rotary shaft 55 surrounding and mounted for rotary movement around the oscillating shaft 54 by means of a pair of rotary bearings, or bearing sets, 80 and 82 carried at opposite ends of the rotary shaft 55. Elimination of the need for continuous lubrication is made possible by spacing the roller bearings 80 and 82 from the translational bearings 58 and 60 and by virtue of the fact that neither set of bearings is required to support the frictional load of both types of motion. The roller bearings 80 and 82 have permanent lubrication seals 81 and 83 to eliminate the need for periodic lubrication. Similarly, because the translational bearings 58 and 60 do not support any relative rotary movement, continuous lubrication required in known oscillating rollers employing a single bearing for both rotational and translational movement is avoided. Instead, only periodic lubrication is required.

Advantageously, the relative translational travel between the oscillating shaft 54 and the stationary shaft 48 is limited by a key slide assembly including an elongate pin shaped stop member 62 transversely mounted to the stationary shaft 48. The stop member 62 extends through a slot 63 in the cylindrical wall of the oscillating shaft 54 for blocking engagement with stop members 64 and 66 at opposite ends of the slot 63 in the oscillating shaft 54 to block movement in opposite directions. The stop member 62 also restrains the oscillating shaft 54 against rotation with the rotary shaft 55.

Another advantageous feature of the invention is provision of a home biasing assembly for biasing the elongate shaft 54 toward a preselected, home position relative to the elongate stationary shaft 48 which is centrally located, as shown in FIG. 2. The home biasing assembly includes a pair of helical springs 68 and 70 each of which has an inner end attached to a center spring anchor 72. The center spring anchor 72 is mounted to the stationary shaft 48 and transversely extends therefrom through a slot 74 in the oscillating shaft 54. The distal ends of the helical springs 68 and 70 are held by transverse spring retaining collars 76 and 79, respectively. These are carried on the outside of the oscillating shaft 54 equidistant from, and on opposite sides of, spring anchor 72 and slot 74.

Whenever the spring retaining collars 76 and 79 are moved away from the center home position with spring anchor 72 in the middle of slot 74, as shown in FIG. 2, one or the other of the springs 68 and 70 is compressed to resiliently bias the oscillating shaft 54 to return to the center position. This spring bias interacts with the frictional lateral forces imposed by the associated vibrational drums to cause the cylindrical shaft 54 to reciprocally oscillate back and forth within the restraints imposed by the movement limiting key slide assembly of stop members 62, 64 and 66.

The elongate, rotary shaft 55 is spaced sufficiently outwardly from the outer surface of the oscillating shaft by the rotary bearings 80 and 82 to provide a space between the outer surface of the oscillating shaft 54 and the inner surface of the rotary shaft 55. Advantageously, this space provides a location for the springs 68 and 70 to perform their function of laterally moving the oscillating shaft 54 relative to the elongate stationary shaft 48. This space also provides a location for the key slide assembly stop members 62, 64 and 66. Advantageously, the rotary bearings 80 and 82 are accessible from the opposite ends 50 and 52 of the stationary shaft 48 to facilitate assembly and maintenance service.

A rubber-like surface cylinder 84 is concentrically, fixedly mounted around the outer wall rotating shaft 55 to rotate therewith. Preferably, the opposite ends 84A and 84B of the rubber-like surface 84 are spaced inwardly from the opposite ends of the elongate oscillating shaft 54 and have edges which are beveled to gradually merge with the outer surface 78 of rotating shaft 55. This bevel provides a stress free boundary at the ends 84A and 84B to reduce uneven distortion at the edges.

Thus, it is seen that the self-oscillating roller assembly 10 contemplates a method of oscillating an oscillating roller along the length of another roller during rotation thereof by means of the steps of (1) rotating a rotary shaft 55 of the oscillating roller assembly relative to an oscillating shaft and (2) longitudinally oscillating the oscillating shaft, preferably along an elongate stationary shaft.

Preferably, the oscillating shaft 54 slides on a pair of coextensive translational bearings 58 and 60 at opposed ends of the oscillating shaft 54 which are periodically lubricated while the rotary shaft 55 surrounding the oscillating shaft 54 rides on permanently lubricated rotary bearings 80 and 82 mounted to and between the rotary shaft 55 and the oscillating shaft 54. The rotary bearings 80 and 82 are physically spaced apart and separated from the pair of translational bearings 58 and 60 by section 54' of oscillating shaft 54 interposed therebetween. The helical springs 68 and 70 spring bias the stationary shaft 48 and oscillating shaft 54 carried thereby to move relative to the stationary shaft toward a preselected home position. This spring bias feature together with smooth action of the translational bearings 58 and 60 enables oscillating the oscillating roller assembly 10 by means of simple rolling contact with a vibrating drum 14A, 14B, 14C and 14D while reducing the rate at which lubrication has to be replaced due to thermal breakdown. The vibrating drum conveys its vibrational movement to the self-oscillating roller assembly 10 through mere frictional contact instead of by means of a complicated set of gears or the like. The relative lateral movement is easily controlled or limited by means of the key slide assembly of slot 63 and stop members 62, 64 and 66.

While a detailed description of the preferred embodiment of the invention has been given, it should be appreciated that many variations can be made thereto without departing from the scope of the invention as set forth in the appended claims. For instance, while it is preferred to mount a rotary shaft to an oscillating shaft, it is also contemplated to mount the oscillating shaft to the rotary shaft. Also, while a single elongate stationary shaft 48 is preferred, a pair of shaft stubs at opposite ends of the oscillating roller assembly 10 could be employed instead since the longitudinal movement is limited. Reference should therefore be made to the appended claims for a determination of the scope of the invention.

I claim:

1. A self-oscillating roller assembly, comprising:

an elongate stationary shaft extending between a pair of opposed fixed ends;

an oscillating shaft assembly including an elongate oscillating shaft with an interior surface extending coextensively with the stationary shaft substantially from said one fixed end to said other fixed end of said stationary shaft, means for mounting the oscillating shaft for sliding movement in the elongate direction of the shaft including a pair of translational bearings adjacent the opposed fixed ends, and means adjacent the opposed fixed ends for mounting the pair of translational bearings to the interior surface of the oscillating shaft; and a rotatable shaft assembly including an elongate rotary shaft, and means physically spaced apart from the translational bearings including a pair of rotational bearings for mounting the rotary shaft for support by and rotational movement around the elongate oscillating shaft.

2. The self-oscillating roller assembly of claim 1 in which the elongate oscillating shaft assembly includes means for biasing the elongate oscillating shaft toward a preselected home position.

3. The self-oscillating roller assembly of claim 2 in which said biasing means includes a spring.

4. The self-oscillating roller assembly of claim 2 in which said biasing means includes a helical spring wound around the elongate oscillating shaft.

5.The self-oscillating roller assembly of claim 1 including means for limiting the extent of relative sliding movement between the elongate oscillating shaft and the stationary shaft.

6. The self-oscillating roller assembly of claim 5 in which the elongate oscillating shaft has a cylindrical wall and said movement limiting means includes a first stop member mounted to the stationary shaft extending through a slot in the cylindrical wall of the elongate oscillating cylindrical shaft and extending laterally therefrom, and a second stop member mounted to the elongate oscillating cylindrical shaft for engagement with the first stop member to block relative movement there between beyond a preselected event.

7.The self-oscillating roller assembly of claim 6 in which said movement limiting means includes a third stop member spaced from said second stop member for engagement with the first stop member to block movement in a direction opposite to a direction of movement blocked by said second stop member.

8. The self-oscillating roller assembly of claim 1 in which the elongate rotary shaft has a cylindrical body along a significant portion of its length, and an inner wall spaced from the oscillating shaft.

9. The self-oscillating roller assembly of claim 8 including means located between the inner wall of the cylindrical body and the oscillating shaft for resiliently laterally moving the elongate oscillating shaft relative to the stationary shaft

10. The self-oscillating roller assembly of claim 8 in which the rotary shaft assembly includes a rubber-like surface cylinder mounted around the rotating shaft to rotate therewith.

11. The self-oscillating roller assembly of claim 1 including a permanently sealed lubrication fitting for providing lubrication for relative rotational movement between the elongate rotary shaft and the oscillating shaft.

12. A method of oscillating an oscillating roller assembly along the length of another roller during rotation thereof, comprising the steps of:

longitudinally oscillating an elongate oscillating shaft along a substantially coextensive stationary shaft by means including a pair of translational bearings at opposed ends of the oscillating shaft, said oscillating shaft extending substantially from one fixed end to another fixed end of the stationary shaft; and rotating a rotary shaft surrounding the oscillating shaft by means including a pair of rotational bearings mounted between the rotary shaft and the oscillating shaft and physically spaced apart and separated from the pair of translational bearings by the oscillating shaft.

13. The method of claim 12 including the steps of lubricating the pair of translational bearings only on a periodic basis during continuous operation.

14. The method of claim 12 including the step of spring biasing the oscillating shaft to move toward a preselected home position.

15. The method of claim 12 including the step of rotating the rotary shaft of the oscillating roller assembly by means of rolling contact of the rotary shaft of the oscillating roller assembly with the other roller.

16.The method of claim 12 including the step of limiting the extent of relative lateral movement between the rotary shaft and the oscillating shaft.

* * * * *